US011793370B1

(12) United States Patent
Ross

(10) Patent No.: US 11,793,370 B1
(45) Date of Patent: Oct. 24, 2023

(54) CLEANING TOOL AND RELATED METHOD

(71) Applicant: CONTEC, INC., Spartanburg, SC (US)

(72) Inventor: Layne Z Ross, Simpsonville, SC (US)

(73) Assignee: CONTEC INC., Spartanburg, SC (US)

( * ) Notice: Subject to any disclaimer, the term of this patent is extended or adjusted under 35 U.S.C. 154(b) by 312 days.

(21) Appl. No.: 17/185,262

(22) Filed: Feb. 25, 2021

Related U.S. Application Data

(60) Provisional application No. 62/981,240, filed on Feb. 25, 2020.

(51) Int. Cl.
*A47K 7/04* (2006.01)
*A47K 11/10* (2006.01)
*A46B 7/04* (2006.01)

(52) U.S. Cl.
CPC ..... *A47K 11/10* (2013.01); *A46B 7/04* (2013.01); *A47K 7/04* (2013.01)

(58) Field of Classification Search
CPC ..... A47L 13/17; A46B 7/04; A47K 11/10
See application file for complete search history.

(56) References Cited

U.S. PATENT DOCUMENTS

| | | | | | |
|---|---|---|---|---|---|
| 2,983,944 | A * | 5/1961 | Uselis | A47L 13/22 | 15/229.11 |
| 4,075,033 | A * | 2/1978 | Knox | A47K 7/08 | 604/289 |
| 5,548,862 | A * | 8/1996 | Curtis | A47L 13/12 | 15/118 |
| 7,127,768 | B2 * | 10/2006 | Blum | A47K 11/10 | 15/210.1 |
| 8,875,337 | B2 * | 11/2014 | Tacoma | B25J 1/04 | 15/210.1 |
| 9,226,628 | B2 * | 1/2016 | Morrison, Jr. | A47K 11/10 | |
| 11,051,667 | B1 * | 7/2021 | Chan | A46B 5/021 | |
| 11,105,023 | B2 * | 8/2021 | Ando | D03D 15/497 | |
| 2009/0163126 | A1 * | 6/2009 | Hatch | A47K 11/10 | 451/461 |
| 2013/0318731 | A1 * | 12/2013 | Newbill | A47K 7/08 | 15/209.1 |
| 2018/0042435 | A1 * | 2/2018 | Mitchell | A47K 17/00 | |
| 2020/0015583 | A1 * | 1/2020 | Mart | A47K 11/10 | |
| 2020/0214515 | A1 * | 7/2020 | Wayne | C11D 17/049 | |
| 2021/0401245 | A1 * | 12/2021 | Maire | E03D 1/26 | |

* cited by examiner

*Primary Examiner* — Michael D Jennings
(74) *Attorney, Agent, or Firm* — J.M. Robertson LLC

(57) ABSTRACT

A manual toilet cleaning tool incorporating an elongated handle of cardboard or similar material permanently affixed to a cleaning pad of biodegradable nonwoven or other suitable material of sufficient abrasive character to provide desired cleaning. The handle may be hollow and be of a generally hydrophilic character which loses its structural integrity when saturated with liquid.

7 Claims, 2 Drawing Sheets

CLEANING TOOL AND RELATED METHOD

CROSS-REFERENCE TO RELATED APPLICATION(S)

This nonprovisional application claims the benefit of, and priority from, U.S. provisional application 62/981,240 filed Feb. 25, 2020. The contents of such provisional application and all other documents referenced herein are hereby incorporated by reference in their entirety as if fully set forth herein.

BACKGROUND OF THE DISCLOSURE

The present disclosure relates generally to cleaning products, and more particularly to a disposable device for manual cleaning toilet bowls and urinals.

BACKGROUND OF THE INVENTION

Restrooms and bathrooms must be cleaned and sanitized on a regular basis to prevent the spread of germs and disease. Health and sanitation concerns require that toilets and urinals be cleaned frequently. This cleaning is typically carried out using a brush attached to an elongated handle. However, once a cleaning device is used, the cleaning device itself may then transfer bacteria and other contaminates to subsequent toilets as it is reused. Thus, the cleaning process itself may lead to the spread of contamination. This issue may be particularly problematic in public buildings and institutional settings such as hospitals, schools, airports and the like.

In recognition of this problem, a number of devices have been developed incorporating reusable handles coupled with removable cleaning elements. While such devices provide some benefit, the reusable handles may still transfer contaminates between toilets. Several systems have been proposed incorporating handles formed from cardboard, paper or similar water-degradable materials such that the entire device is disposable after use. By way of example only, one such system is described in US patent publication 20060174914 to Murphy (incorporated by reference). Another such system is disclosed in US patent publication 20040019996 to Singer (incorporated by reference). While such fully disposable systems may be beneficial if used properly, they are still susceptible to misuse by cleaning personnel who reuse the same device on several toilets before disposal in a well-intentioned effort to reduce waste. Moreover, as best understood, the cleaning surfaces of the prior fully disposable devices are not well configured to promote cleaning by application of pressure during use.

Considering the various noted problems associated with current systems, an alternative disposable cleaning tool that aids in preventing undesirable multiple uses while also promoting cleaning efficiency would represent a useful advancement over the current art.

SUMMARY

The present disclosure offers advantages and alternatives over the prior art by providing a manual toilet cleaning tool incorporating an elongated handle of parallel wound cardboard or similar material permanently affixed to a cleaning pad of polylactic acid (PLA) nonwoven or other biodegradable polymer of sufficient abrasive character to provide desired cleaning. The handle may be hollow and be of a generally hydrophilic character which loses its structural integrity when saturated with liquid. Slits or other liquid openings are provided in the handle in a zone adjacent to the cleaning pad to purposely promote the introduction of water into the handle interior during a cleaning procedure thereby speeding handle saturation and degradation. The handle may be cut and flared at the end to form a plurality of outwardly projecting radial prongs supporting the cleaning pad at its interior.

Figure 1:
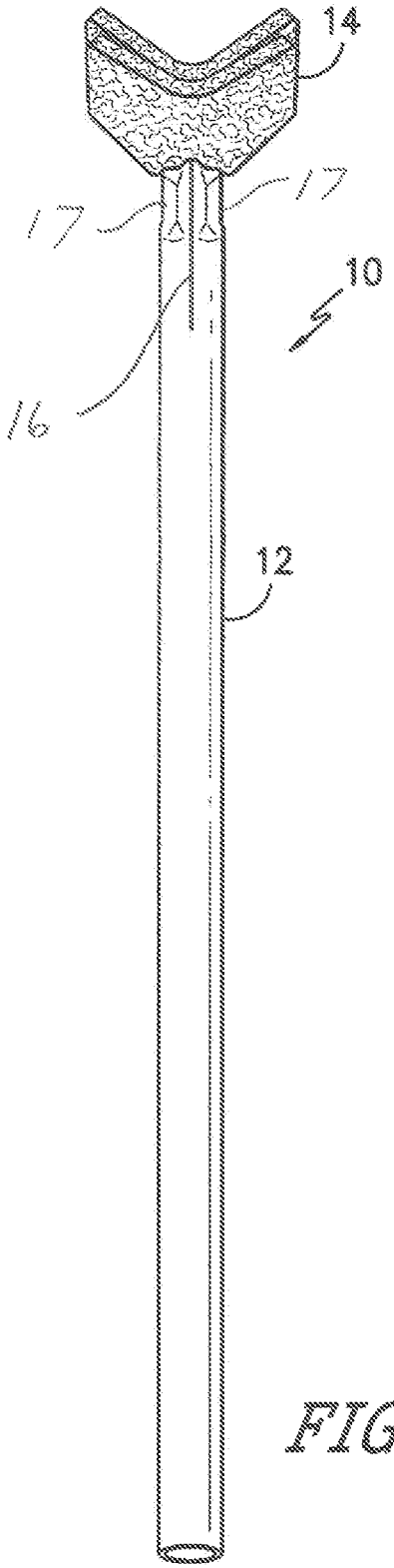
FIG. 1 is an elevation perspective view of a manual cleaning tool consistent with the present disclosure.

Before the exemplary embodiments of the invention are explained in detail, it is to be understood that the invention is in no way limited in its application or construction to the details and the arrangements of the components set forth in the following description or illustrated in the drawings. Rather, the invention is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF POTENTIALLY PREFERRED EMBODIMENTS

An exemplary embodiment consistent with the present disclosure will now be described in reference to the drawings wherein like elements are designated by like reference numerals in the various views. Referring now to the drawings, a manual cleaning tool 10 consistent with the present disclosure is illustrated. As shown, the manual cleaning tool 10 includes a handle 12 of cardboard or a like material permanently affixed to a cleaning pad 14 of PLA or other biodegradable fiber by adhesive, heat bonding or other suitable techniques. By way of example only, and not limitation, the handle 12 may be a parallel wound cylindrical cardboard tube which is hollow along its entire length. However, other materials and constructions may be used if desired.

Figure 2:
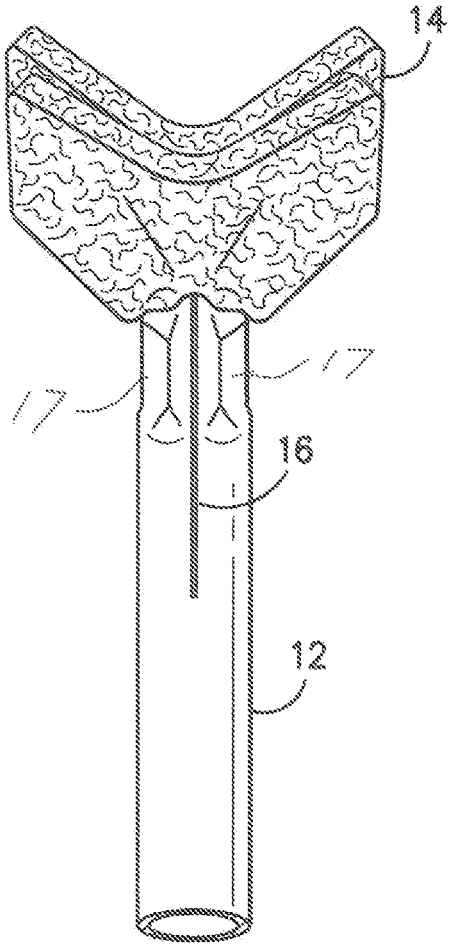
FIG. 2 is a close-up perspective view of the crimped distal end of the manual cleaning tool illustrated in FIG. 1 with a liquid entry slit extending away from the supported cleaning pad.

As best seen in FIGS. 1 and 2, the handle 12 may include one or more fluid openings 16 disposed around the perimeter to facilitate the introduction of fluid into the handle interior when the cleaning pad is submerged. By way of example, the fluid openings may be in the form of longitudinal slits extending away from the cleaning pad 14 as shown. By way of example only and not limitation, a pair of slits (only one shown) may be positioned in radially opposing relation to each other on the handle 12 between compressed crimped segments 17. However, a greater or lesser number of slits may be used as desired. One exemplary construction uses four slits radially positioned in substantially equal distance from one another around the handle. Moreover, other opening geometries such as holes or the like may also be used either alone or in conjunction with one or more slits. Crimping the distal end of the handle may be beneficial in increasing structural support during use.

As noted previously, the introduction of fluid to the handle interior speeds the handle degradation thereby reducing the operative life of the cleaning tool. Such a reduction in operative life may aid in preventing reuse. The fluid contact creates a physical and/or chemical reaction that weakens the handle walls. In this regard, it is contemplated that the handle may include features such as sodium bicarbonate, sodium sulfate or the like that react chemically with the fluid to accelerate the degradation of the handle walls. In addition, it is desirable that the fluid openings 16 be large enough to facilitate rapid drainage of fluid out of the handle core following use to avoid substantial dripping when the handle fails. That is, substantial amounts of fluid should not be trapped in the handle core.

Figure 3:
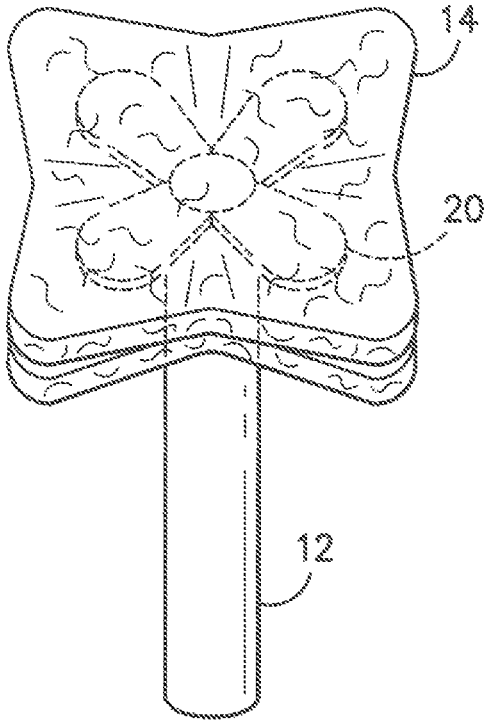
FIG. 3 is an elevation top view of the distal end of the manual cleaning tool illustrated in FIG. 1 illustrating embedded radial support prongs in phantom within a nonwoven cleaning pad.
Figure 4:
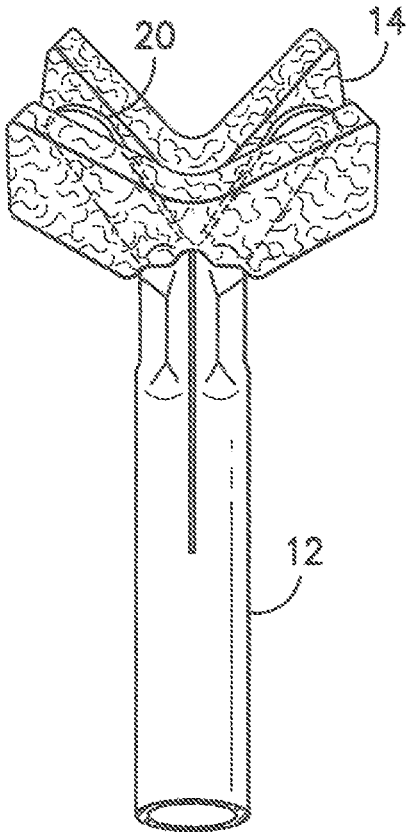
FIG. 4 is a cut-away view of the distal end of a manual cleaning tool consistent with the present disclosure illustrating radial support prongs between layers of a PLA cleaning pad.

As best seen in FIGS. 3 and 4, the distal end of the handle 12 may be cut and flared to create an arrangement of radial prongs 20 extending outwardly away from the distal end of the handle 12. As shown, the radial prongs 20 may be disposed between juxtaposed layers of the cleaning pad 14. In this arrangement, the radial prongs are angled upwardly and act as supportive spring elements thereby elevating the perimeter of the cleaning pad relative to its interior. Thus, in the absence of applied pressure, the cleaning pad will have a generally concave profile. In this regard, it will be understood that while the illustrated embodiment has four radial prongs, a larger or smaller number could likewise be used.

As will be appreciated, when the cleaning pad is pressed against a surface to be cleaned, the radial prongs 20 will be urged downwardly thereby spreading outwardly. This outward spreading will cause the cleaning pad to be tensioned as it moves from its unstressed concave orientation to a more flattened condition. The tensioned pad surface will thereby provide more efficient scrubbing action during cleaning. Because the radial prongs are formed from the handle body, no additional material is required. Moreover, as the prongs become wetted, they will lose resilience thereby further prompting a user to discard the used device.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A hand-manipulated toilet cleaning tool incorporating an elongated handle having a proximal end and a distal end, the handle comprising hydrophilic, water-degradable material, the handle being permanently affixed to a biodegradable polymer cleaning pad at the distal end, the handle including at least one liquid opening extending through a wall of the handle adjacent the polymer cleaning pad, said at least one liquid opening adapted to transport liquid to an interior portion of the handle upon liquid contact, promoting liquid saturation and structural degradation of the handle following liquid contact during use wherein the handle includes a plurality of integral radial prongs projecting outwardly and upwardly away from the distal end, the radial prongs being secured to the polymer cleaning pad and defining supportive spring elements elevating a perimeter of the cleaning pad relative to its interior.

2. The toilet cleaning tool as recited in claim 1, wherein the handle comprises cardboard.

3. The toilet cleaning tool as recited in claim 1, wherein the handle comprises parallel wound cardboard.

4. The toilet cleaning tool as recited in claim 1, wherein the polymer cleaning pad comprises polylactic acid nonwoven.

5. The toilet cleaning tool as recited in claim 1, wherein the handle comprises a cylindrical hollow tube.

6. The toilet cleaning tool as recited in claim 5, comprising a plurality of longitudinal slits extending through a perimeter wall of the handle adjacent the polymer cleaning pad.

7. The toilet cleaning tool as recited in claim 1, wherein the radial prongs are disposed in sandwiched relation between juxtaposed layers of the polymer cleaning pad.

* * * * *